US012623273B2

(12) United States Patent
Sguotti et al.

(10) Patent No.: US 12,623,273 B2
(45) Date of Patent: May 12, 2026

(54) EQUIPMENT AND METHOD FOR FORMING A FRONT TOOTHING ON AN INNER RING OF A WHEEL HUB

(71) Applicant: AKTIEBOLAGET SKF, Gothenburg (SE)

(72) Inventors: Laura Sguotti, Bricherasio (IT); Davide Antonio Olivieri, Turin (IT)

(73) Assignee: AKTIEBOLAGET SKF (SE)

( * ) Notice: Subject to any disclaimer, the term of this patent is extended or adjusted under 35 U.S.C. 154(b) by 0 days.

(21) Appl. No.: 17/588,229

(22) Filed: Jan. 29, 2022

(65) Prior Publication Data

US 2022/0241841 A1 Aug. 4, 2022

(30) Foreign Application Priority Data

Feb. 3, 2021 (IT) ..... 1020210002249

(51) Int. Cl.

| | |
|---|---|
| ***B21J 5/12*** | (2006.01) |
| ***B21D 53/26*** | (2006.01) |
| ***B21J 9/02*** | (2006.01) |
| ***B21K 1/30*** | (2006.01) |
| ***B21K 21/12*** | (2006.01) |

(52) U.S. Cl.

CPC ..... *B21J 5/12* (2013.01); *B21D 53/265* (2013.01); *B21J 9/02* (2013.01); *B21K 1/30* (2013.01); *B21K 21/12* (2013.01); *B21J 9/025* (2013.01)

(58) Field of Classification Search

CPC ..... B21J 9/02; B21J 9/025; B21J 5/12; B21K 1/40; B21K 1/30; B21K 21/12

See application file for complete search history.

(56) References Cited

U.S. PATENT DOCUMENTS

| | | | | |
|---|---|---|---|---|
| 4,983,960 | A | 1/1991 | Dunn | |
| 2010/0077826 | A1* | 4/2010 | Prussak | B21J 5/02 72/256 |
| 2010/0146790 | A1* | 6/2010 | Gingrich | F16C 43/04 29/898 |
| 2012/0267944 | A1* | 10/2012 | Toda | B60B 27/0031 301/105.1 |
| 2013/0181376 | A1* | 7/2013 | Morello | B21K 25/00 264/293 |
| 2014/0376848 | A1* | 12/2014 | Duch | F16C 33/768 384/448 |
| 2021/0402460 | A1 | 12/2021 | Bogliacino et al. | |

FOREIGN PATENT DOCUMENTS

| | | |
|---|---|---|
| EP | 2284021 | 2/2011 |
| EP | 2422995 | 2/2012 |
| EP | 2514605 | 10/2012 |
| EP | 2551033 | 1/2013 |

* cited by examiner

*Primary Examiner* — Christopher J. Besler
(74) *Attorney, Agent, or Firm* — Reed Smith LLP

(57) ABSTRACT

Equipment and method in which a creator tool is pressed against an annular upset collar of an inner ring of a wheel hub and is provided towards the collar with a toothing complementary to the toothing to be obtained, formed by a plurality of radial teeth separated by respective radial spaces, all arranged radially in a circular crown, symmetrically with respect to a first axis (B) defining the axis of symmetry of the tool; wherein the creator tool is provided with an annular radial containment element configured to delimit a continuous wall which closes off respective radially outer ends of the radial spaces.

16 Claims, 5 Drawing Sheets

EQUIPMENT AND METHOD FOR FORMING A FRONT TOOTHING ON AN INNER RING OF A WHEEL HUB

CROSS-REFERENCE RELATED APPLICATION

This application is based on and claims priority to Italian Patent Application No. 10202100002249 filed on Feb. 3, 2021, under 35 U.S.C. § 119, the disclosure of which is incorporated by reference herein.

FIELD

The present disclosure relates to forming a front toothing on an inner ring of a wheel hub.

BACKGROUND

In wheel hubs, face teeth are intended to form a head-to-head coupling between an inner ring of the wheel hub and the corresponding face teeth of an outer ring.

BRIEF DESCRIPTION OF THE DRAWINGS

Further features and advantages of the present disclosure will become clear from the following description of non-limiting exemplary embodiments thereof, provided with reference to the attached figures, in which.

DETAILED DESCRIPTION

Figure 1:
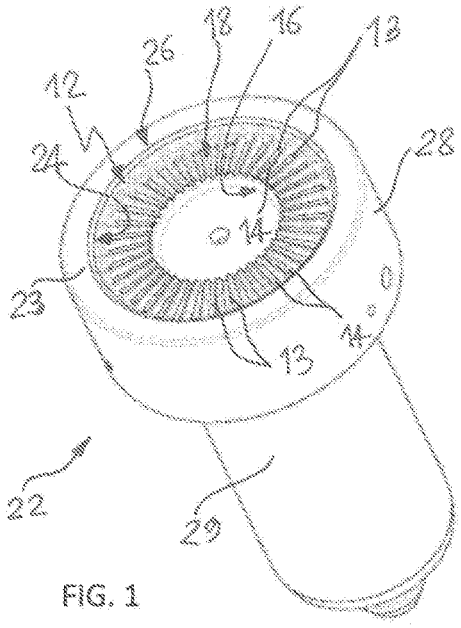
FIG. 1 schematically shows a perspective three-quarter view from below, flipped over by 180° for a clearer understanding, of a tool constituting a part of equipment according to the present disclosure for producing, by plastic deformation, a front toothing on an inner ring of a wheel hub.

In various embodiments of wheel hubs in accordance with this disclosure, a front toothing serves the function of providing a head-to-head coupling of an inner ring of a wheel hub to a corresponding front toothing of an outer ring of a constant-velocity joint, so as to ensure the transmission of torque from the constant-velocity joint to the inner ring of the wheel hub, which carries a wheel of the vehicle via a flanged end.

A coupling of this type is described in U.S. Pat. No. 4,893,960. According to that document, helical teeth may be obtained at the same time as the upset collar, by means of a relatively complex and bulky tool made up of three elements that are independent of and movable relative to one another.

This tool is not only complex, bulky and expensive, but also does not make it possible to obtain such teeth with a highly constant tooth profile, which is an important feature in light of the increasingly high torques to be transmitted in modern applications.

EP2551033B1 attempts to solve this problem by a technique involving an upset collar formed by orbital forming, with a predetermined first profile; and, subsequently, in a second step, a front toothing is produced by pressing on the upset collar a creator tool comprising a shank and a head, both symmetrical with respect to a first axis defining the axis of symmetry of the tool, about which the tool is rotated, the head consisting of a solid metal block having, towards the upset collar, a front annular projecting part bearing a toothing complementary to the toothing to be obtained.

During the pressing step disclosed in EP2551033B1, the creator tool is rotated so as to describe an orbital movement, keeping the first axis inclined relative to an axis of symmetry of the wheel hub, and is simultaneously pushed against the upset collar in the direction of the first axis, i.e., along this axis, so as to imprint on the upset collar, in sequence, one or more teeth of the complementary toothing until the front toothing is completely formed on the upset collar.

Because the ridges of the teeth of the complementary toothing borne by the creator tool are rounded and have a radius that is variable in the radial direction, specifically decreasing in the direction towards the first axis, or increasing in a direction radially away from the first axis, it is possible to obtain a front toothing with teeth having a constant profile at a given radial distance from the first axis and which are a negative "copy" of the teeth of the complementary toothing borne by the creator tool. However, the teeth of the front toothing thus obtained have teeth ridges or "heads" which, although they are all rounded, as per the design, end up flattened during the forming process. It has been learned that this leads to substantial problems in intended applications.

This can cause, during assembly between the wheel hub and constant-velocity joint, incorrect tooth/tooth mounting, which means that the teeth of the two components do not intermesh properly. This prevents, in use, the corresponding tooth of the constant-velocity joint from correctly intermeshing, dropping into one of the troughs between the teeth of the front toothing of the wheel hub, said troughs defining the bottom of said front toothing.

Subsequently, with the teeth of the wheel hub/constant-velocity joint unit incorrectly assembled, owing to the weight of the vehicle in which it is received, or during the first transmission of torque from the constant-velocity joint to the vehicle wheel, they naturally snap into the correct position. As a result, the central nut or screw used to lock the two components together immediately loses the clamping force imparted during assembly and frontal play may also be created between the two coupled toothings of the wheel hub and constant-velocity joint, although without diminishing the transmission of torque.

This gives rise to a hissing noise on the axle due to the fact that the teeth jump out of the correct position of engagement every time higher torques are transmitted, since the clamping force of the central screw has been at least partially lost.

In a vehicle subjected to these conditions, the teeth are gradually ground down, resulting in total loss of traction in 2WD vehicles (two-wheel drive) since even just one side lacking traction prevents traction of the entire vehicle owing to the mechanics of the axle differential. In an AWD vehicle (four wheel drive, not always engaged), there is conversely partial loss of traction for the vehicle.

In both cases, this issue can gradually destroy the gearbox, if the driver does not notice the loss of power on an axle, since the vehicle CPU will not detect anomalies soon enough, as the axle without traction still sends a plausible ABS signal.

The aim of the present disclosure is to provide equipment and techniques for forming by plastic deformation a front toothing on an inner ring of a wheel hub, that overcomes the drawbacks of known equipment and methods and, in particular, that is capable of affording both greater precision in terms of the dimensions of the teeth and highly constant dimensions and geometry in the profile of the teeth. An equipment and method in accordance with this disclosure further prevents the flattening of the head or ridge of the teeth in the front toothing obtained by orbital forming, which leads to failures in their applications.

Embodiments in accordance with this disclosure therefore provide improved equipment and techniques for forming by plastic deformation a front toothing on an inner ring of a wheel hub.

Figure 3:
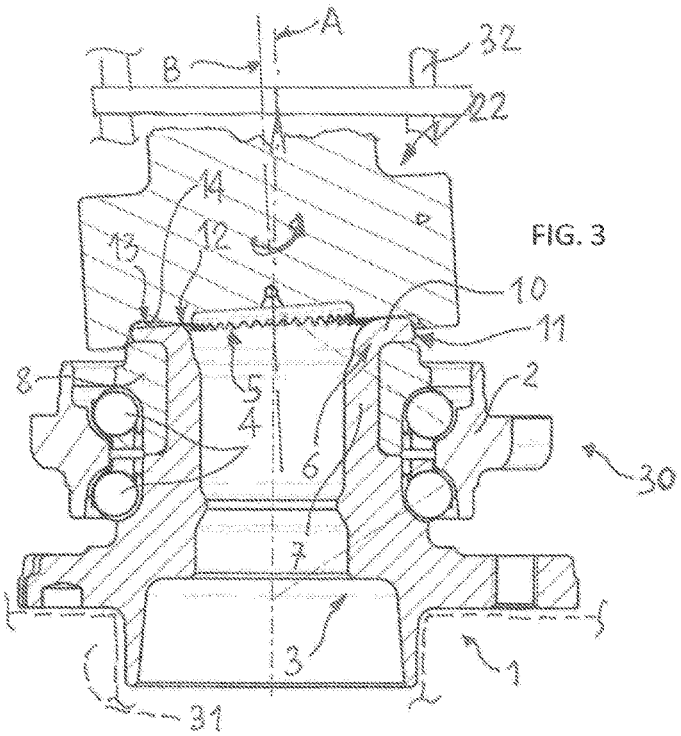
FIG. 3 schematically shows, on a slightly smaller scale, a view in elevation and in radial cross section of embodiments of equipment in accordance with this disclosure during a process of producing by plastic deformation a front toothing on an inner ring of a wheel hub, which is also shown in radial section, in accordance with this disclosure.

Referring to FIG. 3, a wheel hub 1 having an outer ring 2 which is intended in use to be connected to a suspension upright (not shown) of a vehicle, and an inner ring 3, between which are arranged two rows of rolling elements 4, illustrated here as balls but which may take other shapes as will be appreciated by a POSA upon review of this entire disclosure.

Inner ring 3 may be operationally associated, in use, with a constant-velocity joint, not shown for the sake of simplicity, by means of a front toothing 5 obtained on a first end 6 thereof and configured to receive, in use, a wheel of a vehicle at an opposite end to first end 6.

In a non-limiting example shown, inner ring 3 may include a spindle 7 defining first end 6, and a second ring 8 pressed against first end 6, which faces, in use, said constant-velocity joint. Inner ring 3, spindle 7 and second ring 8 are mutually coaxial, having a shared axis of symmetry A which coincides with a general axis of symmetry of wheel hub 1.

Inner ring 3 may be provided with an upset collar 10, which is obtained in a known manner, not described for the sake of simplicity, by orbital forming, by plastic deformation of the first end 6; the collar 10 has a first predetermined radial profile, which is known.

In a non-limiting embodiment shown, second ring 8 may be axially locked on spindle 7 by means of upset collar 10, which projects axially with respect to second ring 8.

In any case, collar 10 bears front toothing 5, which is formed on a front end face thereof which is arranged substantially perpendicular to the axis of symmetry A of the wheel hub 1, in general, and of inner ring 3, in particular.

Also with reference to FIG. 1, a front toothing 5 is obtained by means of an equipment 30 (e.g., FIG. 3) for orbital forming by plastic deformation, of known type and similar to that normally used for the orbital forming (known) of a collar 10 on an inner ring 3 of a wheel hub 1.

An equipment 30 may include a base 31, shown in dotted line only partially and only schematically in FIG. 3, and a support constituting a framework 32, which is substantially rigid, known and shown only partially, which supports, in a known manner not shown for the sake of simplicity, a single creator tool 22 (e.g., FIGS. 1, 2 and 3), having an axis of symmetry B.

A single creator tool 22 may be provided with, towards an upset collar 10, with a toothing 12 complementary to a toothing 5 to be obtained.

Complementary toothing 12 may be formed by a plurality of radial teeth 13 and a plurality of radial spaces 14 separating each of the plurality of radial teeth 13.

Teeth 13 and radial spaces 14 may be arranged radially in such a way as to form/define, a circular crown, teeth 13 being spaced apart radially with a constant pitch by means of radial spaces 14 and symmetrically with respect to an axis of symmetry B of tool 22.

Figure 7:
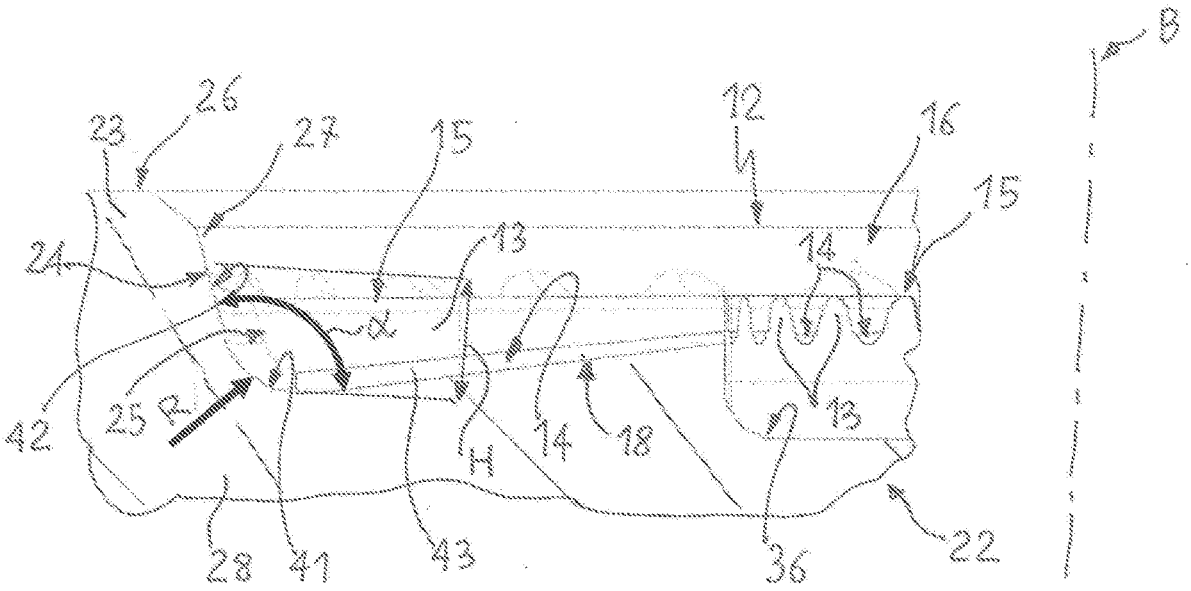
FIG. 7 schematically shows a view on an enlarged scale of a detail of various embodiments of a tool as illustrated by FIGS. 1 and 2.

According to an exemplary embodiment in accordance with this disclosure, and with reference also to FIG. 7, a creator tool 22 may include an annular radial containment element 23, which is arranged radially on an outside of the circular crown defined/formed by a complementary toothing 12. In another embodiment, annular radial containment element 23 may be arranged radially on an inside (not particularly illustrated) of the circular crown defined/formed by a complementary toothing 12.

Annular radial containment element 23 is configured so as to delimit towards toothing 12 and form a continuous wall 24 that closes off respective radially outer ends 25 of radial spaces 14. In some embodiments, respective radially outer ends 25 may be respective radially inner ends of radial spaces 14.

According to various embodiments in accordance with this disclosure, an annular radial containment element 23 may be arranged radially on the outside of the circular crown defined by complementary toothing 12 and configured such that continuous wall 24 closes off respective radially outer ends 25 of radial spaces 14, over a depth H of outer ends 25, measured in an axial direction Teeth 13 of complementary toothing 12 may have a top defined by ridges 15 (e.g., FIGS. 2 and 7) Each individual ridge 15 may be rounded by a substantially continuous curve (e.g., simple: arc of a circle, ellipse, parabola; or complex: combination of the above and/or of polynomial curves) orientated in a radial direction with respect to axis B.

Similarly, radial spaces 14 have base portions 43 which may be concave, rounded, and symmetrical, at least in terms of shape, to ridges 15.

According to a preferred embodiment in accordance with this disclosure, radial containment element 23 has an axial length that is greater than an axial length (i.e., when measured in a direction parallel to axis B) of teeth 13, such that radial containment element 23 extends axially further than ridges 15 of teeth 13 at outer radial ends 25 of radial spaces 14. In various un-illustrated embodiment, a radial containment element is disposed on radially inner ends of radial spaces 14, and likewise extends axially further than ridges 15 of teeth 13 at the radially inner end (i.e., ends of teeth radially towards axis B).

Figure 2:
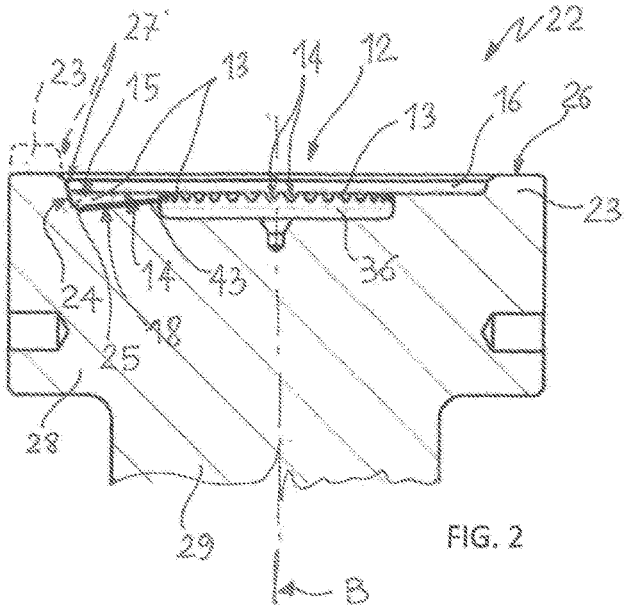
FIG. 2 schematically shows, on an enlarged scale and in radial section, a view in elevation of a detail of the tool embodiments illustrated in FIG. 1.

With reference to FIG. 2, a radial containment element 23 may extend substantially further than ridges 15 of teeth 13 in an axial direction, such that radial containment element 23 is configured to interact, during a pressing step (e.g., FIG. 3), with a radially outer edge 11 of a collar 10 axially below (i.e., beyond) a front toothing 5 to be formed and therefore well beyond complementary toothing 12 and related ridges 15 of teeth 13. The dotted line of FIG. 2 is intended to illustrate various embodiments having axially extending in lengths greater than the axial extent of ridges 15.

A creator tool 22 may include a substantially flat front face 26, which is configured so as to face, in use, a collar 10 (e.g., FIG. 3) and which bears, as will be seen, a complementary toothing 12.

An annular radial containment element 23 may delimit radially, on the outside, a face 26, defining a radially outer annular portion thereof. In various unillustrated embodiments an inner annular radial containment unit extending at a radially inner end of radially extending teeth 13, an annular radial containment element may also delimit radially, on the inside, a face defining a radially inner annular portion thereof.

According to various embodiments in accordance with this disclosure, illustrated in, e.g., FIGS. 1, 2, 3, 4 and 7, a complementary toothing 12 is arranged inside a shallow recess 16 made centrally on a front face 26 of a creator tool 22. In particular, complementary toothing 12 is formed entirely, or at least partially, on a bottom wall 18 of shallow recess 16 and a annular radial containment element 23 that is defined by a radially outer and continuous edge 27 of shallow recess 16.

An exemplary creator tool 22 may be sturdy (i.e. a solid tool, of relatively high mass) and include a head 28 and a shank 29 that are both symmetrical with respect to an axis B defining an axis of symmetry of creator tool 22, about which creator tool 22 describes an orbital movement in a clockwise direction (e.g., FIG. 3).

An exemplary head 28 include a solid metal block having a cylindrical shape, and beartoothing 12 complementary in shape to a shape of a desired toothing 5 to be obtained in accordance with this disclosure.

An exemplary shank 29 may be a cylindrical shape and may include a solid metal element. A shank 29 may be made as a single piece with head 28. Shank 29 may have a diameter such as to have, in the direction transverse to the axis B, dimensions (e.g. a diameter) smaller than those of head 28. Thus, during a pressing step (e.g. FIG. 3), an outer annular part of head 28, which projects all the way round shank 29, may flex elastically ever so slightly, forming toothing 5 much more precisely. During a pressing step, creator tool 22 may be rotated such as to obtain an orbital motion, keeping axis B inclined with respect to an axis A of symmetry of the wheel hub 1. Creator tool 22 may be simultaneously pushed against collar 10 in the direction of axis B (i.e. in an oblique direction with respect to collar 10), so as to imprint on collar 10, in sequence, one or more teeth 13 of complementary toothing 12, until front toothing 5 is completely formed on collar 10, according to a method known as "orbital forming."

Figure 4:
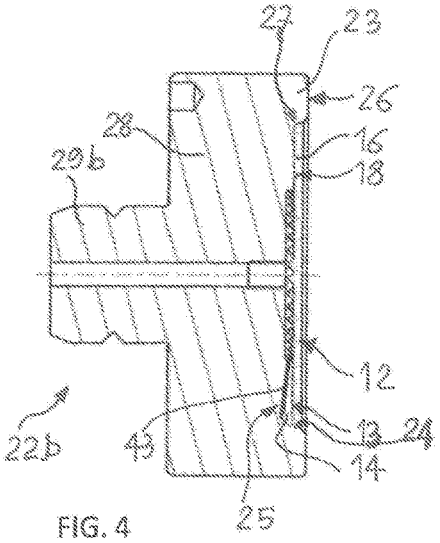
FIG. 4 schematically shows a view in radial cross section of various embodiments of the tool illustrated in FIG. 1.

FIG. 4 illustrates various embodiments in accordance with the present disclosure. A creator tool 22*b* may include a shank 29*b* that is shorter than a shank 29 of a creator tool 22 (e.g. FIG. 1, 2, 3), while a head 28 remains substantially identical.

Rounded ridges 15 of teeth 13 may extend radially in such a way that teeth 13 have a progressively decreasing axial length (i.e. are progressively lower in a radially inward direction towards axis B, as can be seen in FIGS. 2 and 7. Moreover, a radius of a curvature, of ridges 15, measured in a radial direction, may decrease progressively towards axis B. A radius of a curvature of base portions 43 of radial spaces 14, measured in a radial direction, may decrease progressively towards axis B.

Figure 5:
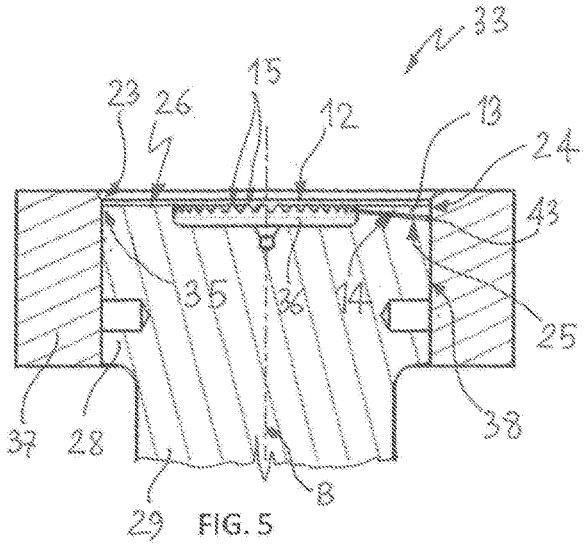
FIG. 5 schematically shows in radial section a view in elevation of the same detail as FIG. 2 but with reference to second various embodiments of embodiments of a tool as illustrated by FIG. 1.
Figure 6:
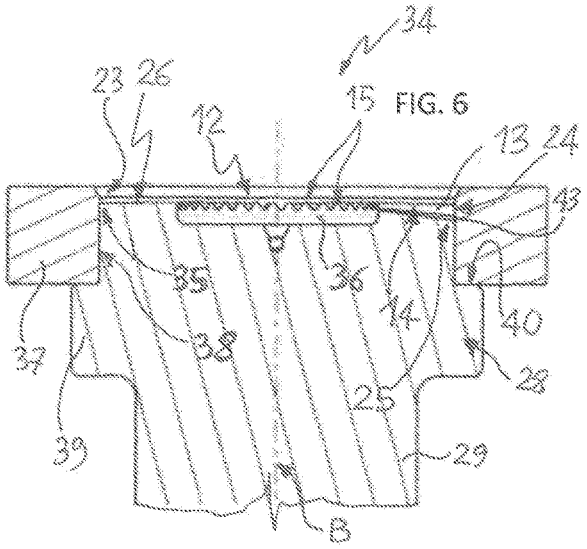
FIG. 6 schematically shows in radial cross section a view in elevation of the same detail as FIG. 2 but with reference to third various embodiments of a tool as illustrated by FIG. 1.

FIG. 5 and FIG. 6 illustrate various different embodiments in accordance with the present disclosure.

In particular, an equipment 30 of FIG. 3, instead of having a creator tool 22 (or 22*b*) as described above, has an exemplary creator tool 33, in accordance with FIG. 5, or an exemplary creator tool 34, in accordance with FIG. 6.

Creator tool 33 may include a head 28 and a shank 29, and a substantially flat front face 26, configured so as to face, in use, a collar 10 and delimiting, towards collar 10, head 28.

A complementary toothing 12 may be made on front face 26, between a radially outer edge 35 and a radially inner central shallow recess 36 in front face 26. Shallow recess 36 may be arranged substantially flush with a base 43 of the radial spaces 14.

In various embodiments, central shallow recess 36 may be provided on ahead 28 of a creator tool 22 or a creator tool 22*b*.

In the case of a creator tool 33 and a creator tool 34, an annular containment element 23 may consist of a very rigid ring 37 arranged radially on the outside of radially outer edge 35 of front face 26, fitted on, or attached coaxially to, a radially outer side wall 38 of creator tool 33 and creator tool 34, delimiting radially outer edge 35 of front face 26.

A ring 37 may be rigidly secured to head 28, coupled by interference to side wall 38 and/or rigidly secured to the latter in any other suitable manner. In some embodiments, a ring 37 may be pressed on a head 28 to rigidly secure ring 37.

According to various embodiments of the present disclosure (e.g., FIG. 6), radially outer side wall 38 of creator tool 34 has, on a side opposite a front face 26, a cylindrical stop 39 defining an axial shoulder 40 against which the ring 37 bears.

This configuration, although slightly more expensive in production terms, is however more secure as it creates an additional mechanical connection between side wall 38 and ring 37, which may, in use, during the pressing step, be stressed not only radially but also axially.

Regarding various embodiments I accordance with FIGS. 1-4, in which containment element 23 forms a single piece with head 28, in fact consisting of a radially outer annular portion thereof, various embodiments in accordance with FIGS. 5 and 6 make it possible to have a containment element made as an independent part which may therefore be made of the material best able to withstand mechanical stresses occurring in a pressing step.

An annular containment element 23 may have a predetermined radial profile defined by the shape of a continuous wall 24 and towards a complementary toothing 12, in radial spaces 14 of complementary toothing 12 and delimited thereby.

With reference to FIG. 7, which is on an enlarged scale, a predetermined radial profile of a continuous wall 24 defined by a containment element 23 preferably includes a first portion 41, which is curved and immediately adjacent to bases 43 of radial spaces 14, and a second portion 42, which is substantially straight, positioned immediately adjacent to first portion 41 and on a side opposite to bases 43 and arranged obliquely to axis B.

According various embodiments in accordance with this disclosure, for optimum distribution of mechanical stresses during a pressing step, a first portion 41 must have a radius of curvature R (e.g., FIG. 7) of between 1 and 4 mm and a second portion 42 may make, with a base 43 a radial space 14, an angle $\alpha$ of between 90 and 135°.

Figure 8:
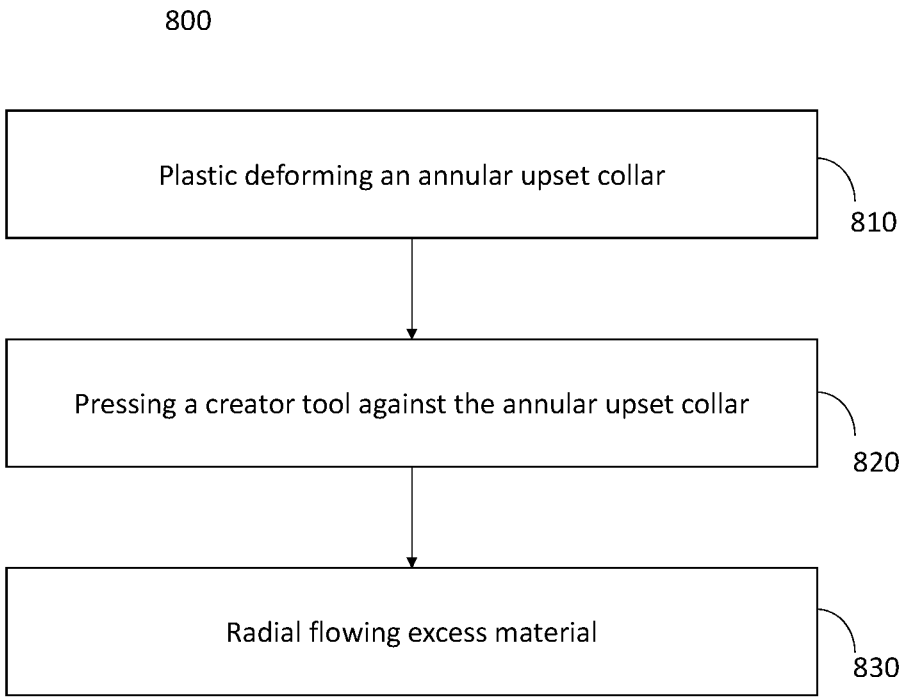
FIG. 8 illustrates aspects of various methods of forming a front toothing in accordance with this disclosure.

With reference to the flow chart of FIG. 8, the present disclosure describes an exemplary embodiment of a method for forming by plastic deformation a front toothing 5 on an inner ring of a wheel hub 1.

Method 800 may include a plastic deformation step 810. Plastic deformation step 810 may include plastically deforming an annular upset collar 10, previously formed (in a known manner) on one end 6 of an inner ring 3 of a wheel hub 1 and having a predetermined radial profile. The predetermined radial profile may be defined in order to produce frontally on collar 10 a front toothing 5 by axially and sequentially pressing on collar 10 a creator tool, e.g. 22, 22*b*, 33, 34. A creator tool may be provided with a toothing 12 towards collar 10 and complementary to front toothing 5 to be obtained and formed by a plurality of radial teeth 13 and respective radial spaces 14 separating teeth 13, all arranged annularly and symmetrical with respect to a first axis B defining an axis of symmetry of creator tool, e.g. 22, 22*b*, 33, 34.

Method 800 may further include a pressing step 820. During pressing step 820, creator tool, e.g. 22, 22*b*, 33, 34, may be rotated to obtain an orbital motion, keeping axis B inclined with respect to an axis of symmetry A of wheel hub 1. Creator tool, e.g. 22, 2*b*, 33, 34, may be simultaneously pushed against collar 10 in an axial direction of axis B, so as to imprint on collar 10, in sequence, one or more teeth 13 of complementary toothing 12 until front toothing 5 is completely formed on collar 10.

Method 800 may further include a radial flowing step 830. Radial flowing step 830 may include radial flowing of excess material from which collar 10 is made, resulting from localized plastic deformation of collar 10 caused by teeth 13 of the creator tool (22, 22*b*, 33, 34). In radial flowing step 830, an annular radial containment element 23, which is arranged radially on the outside (or inside) of the circular crown defined by complementary toothing 12, may block excess material so as to delimit a continuous wall 24 that closes off respective radially outer ends 25 of radial spaces 14.

In another embodiment, radially outer ends 25 may be radially inner ends.

During the step of plastic deformation, a metal from which collar 10 is made "flows," forming troughs and individual teeth of front toothing 5 with metal that has been displaced.

A creator tool according to the invention (e.g. 22, 22*b*, 33, 34) retains, in the radial direction, the material of the collar 10 which is flowing under the thrust of the plastic deformation so as to form front toothing 5. Consequently, metal of collar 10, being unable to move radially, is forced to "rise up" and press against radial spaces 14 of complementary toothing 12, until metal fills radial spaced 14 completely.

As radial spaces 14 are substantially mirror-image symmetrical (i.e. symmetric only in terms of shape, not dimensions) to teeth 13, bases 43 may be rounded and, consequently, at the end of a pressing step, a toothing 5 will be obtained in which all the teeth have a ridge 15 which is rounded.

Various embodiments in accordance with this disclosure apply to a wheel hub the inner ring of which comprises a spindle, provided with a first raceway for a first row of rolling elements, and a small inner ring, provided with a second raceway for a second row of rolling elements, in which the small inner ring is locked axially on the spindle by means of an upset collar, defined by an end segment of the spindle which has been deformed plastically.

In some embodiments, the flow of material during plastic deformation is insufficient, and thus ridges 15 may be less flattened.

We claim:

1. A device for forming a front toothing on an inner ring of a wheel hub, the device comprising:

a unitary creator tool, having an axis of symmetry (B), the unitary creator tool comprising:

a solid central portion;

a first complimentary toothing positioned annularly about the solid central portion and configured to form the front toothing of the inner ring, the first complimentary toothing comprising:

a plurality of radially extending teeth, wherein each tooth of the plurality of radially extending teeth comprises a ridge at a top end of the tooth defining a rounded radial profile; and a plurality of radially extending spaces separating the plurality of radially extending teeth respectively, wherein the plurality of radially extending teeth and the plurality of radially extending spaces are arranged annularly about the axis of symmetry (B); and an annular radial containment element radially disposed on an outside of the plurality of radially extending teeth and configured to define a continuous wall, wherein the continuous wall closes a radially outer end of each of the plurality of radially extending spaces;

wherein, at an axially outermost end of the unitary creator tool, an axially outermost end surface of the annular radial containment element extends axially beyond an axially outermost end surface of the solid central portion.

2. The device of claim 1, wherein the annular radial containment element is arranged radially on an outside of a circular crown defined by the complementary toothing and configured such that the continuous wall encloses a radially outer end of each of the plurality of radially extending spaces over an axial height (H) of the plurality of radially extending spaces.

3. The device of claim 1, wherein the radial containment element is positioned axially higher than the ridge of each tooth so as to extend axially beyond the ridges of the teeth at a radially outer end of the plurality of radial spaces.

4. The device of claim 3, wherein an axial height of each ridge of each of the plurality of radially extending teeth progressively decreases in a radially inward direction and with a radius of curvature of the ridge, measured radially, progressively decreasing in a radially inward direction.

5. The device of claim 2, wherein the unitary creator tool further comprises a substantially flat front face configured to face towards a collar of the inner ring when in use.

6. The device of claim 5, wherein the complementary toothing is disposed within a shallow recess formed on the front face of the creator tool and on a bottom wall of the shallow recess.

7. The device of claim 6, wherein the annular radial containment element is defined by a radially outer and continuous edge of the shallow recess.

8. The device of claim 5, wherein the complementary toothing is formed on the front face of the unitary creator tool between a radially outer edge and a radially inner central shallow recess of the front face, the shallow recess disposed substantially flush with a base of each of the plurality of the radial spaces.

9. The device of claim 8, wherein the annular radial containment element comprises a ring disposed radially on the outside of the radially outer edge of the front face of the unitary creator tool and attached coaxially to a radially outer side wall of the creator tool delimiting the radially outer edge of the front face.

10. The device of claim 9, wherein the radially outer side wall of the unitary creator tool is provided with a cylindrical stop on a back face opposite the front face, the cylindrical stop having a diameter greater than a diameter of the front face, the cylindrical stop further defining an axial shoulder against which the ring of the annular radial containment element rests.

11. The device of claim 1, wherein the annular radial containment element and the plurality of radial spaces of the complementary toothing define a predetermined radial profile, the radial profile comprising:

a first stretch, the first stretch being curved and immediately adjacent to a base of each of the plurality of radial spaces; and a second stretch, the second stretch being substantially straight and arranged immediately adjacent to the first stretch on a side opposing the base of each of the plurality of radial spaces and obliquely to the axis B.

12. The device of claim 11, wherein the first stretch has a radius of curvature (R) between 1 and 4 mm.

13. The device of claim 12, wherein the second stretch forms an angle with the bottom of each of the plurality of radial spaces of between 90° and 135°.

14. The device of claim 1, wherein the radial profile of each rounded ridge comprises a continuous curve.

15. A device for forming a front toothing on an inner ring of a wheel hub, the device comprising:

a unitary creator tool, having an axis of symmetry (B), the unitary creator tool comprising:

a solid central portion, wherein the solid central portion comprises an axially external surface;

a first complimentary toothing positioned annularly about the solid central portion and configured to form the front toothing of the inner ring, the first complimentary toothing comprising:

a plurality of radially extending teeth, wherein each tooth of the plurality of radially extending teeth comprises a ridge at a top end of the tooth defining a rounded radial profile; and a plurality of radially extending spaces separating the plurality of radially extending teeth respectively, wherein the plurality of radially extending teeth and the plurality of radially extending spaces are arranged annularly about the axis of symmetry (B); and an annular radial containment element radially disposed on an outside of the plurality of radially extending teeth and configured to define a continuous wall, the continuous wall closing a radially outer end of each of the plurality of radially extending spaces, wherein the annular radial containment element comprises an axially external surface;

wherein the axially external surface of the solid central portion is positioned in an axially inner position relative to the axially external surface of the radial containment element.

16. A device for forming a front toothing on an inner ring of a wheel hub, the device comprising:

a unitary creator tool, having an axis of symmetry (B), the unitary creator tool comprising:

a solid central portion, wherein the solid central portion comprises an axially outermost surface;

a first complimentary toothing positioned annularly about the solid central portion and configured to form the front toothing of the inner ring, the first complimentary toothing comprising:

a plurality of radially extending teeth, wherein each tooth of the plurality of radially extending teeth comprises a ridge at a top end of the tooth defining a rounded radial profile; and a plurality of radially extending spaces separating the plurality of radially extending teeth respectively, wherein the plurality of radially extending teeth and the plurality of radially extending spaces are arranged annularly about the axis of symmetry (B); and an annular radial containment element radially disposed on an outside of the plurality of radially extending teeth and configured to define a continuous wall, the continuous wall closing a radially outer end of each of the plurality of radially extending spaces, wherein the annular radial containment element comprises an axial surface;

wherein the axially outermost surface of the solid central portion is in an axially inner position relative to the axial surface of the radial containment element.

* * * * *